US005118283A

United States Patent [19]

Sattelmayer

[11] Patent Number: 5,118,283

[45] Date of Patent: * Jun. 2, 1992

[54] COMBUSTION INSTALLATION

[75] Inventor: Thomas Sattelmayer, Mandach, Switzerland

[73] Assignee: Asea Brown Boveri Ltd., Baden, Switzerland

[ * ] Notice: The portion of the term of this patent subsequent to Sep. 3, 2008 has been disclaimed.

[21] Appl. No.: 514,277

[22] Filed: Apr. 25, 1990

[30] Foreign Application Priority Data

Apr. 27, 1989 [CH] Switzerland ..... 1612/89

[51] Int. Cl.[5] ..... F23M 9/00; F23M 3/00

[52] U.S. Cl. ..... 431/9; 431/182; 431/11; 431/8; 431/351; 431/243; 431/187

[58] Field of Search ..... 431/2, 4, 8, 9, 10, 431/11, 12, 173, 182, 187, 188, 285, 278, 242, 239, 350, 351, 353, 115; 60/39, 464, 743; 110/264, 347

[56] References Cited

U.S. PATENT DOCUMENTS

| | | | |
|---|---|---|---|
| 3,174,526 | 3/1965 | Von Linde | 431/116 |
| 3,258,052 | 6/1966 | Wilson et al. | 431/115 |
| 4,380,429 | 4/1983 | LaHaye et al. | 431/115 |
| 4,926,765 | 5/1990 | Driezler et al. | 431/115 X |
| 4,932,861 | 6/1990 | Keller et al. . | |

FOREIGN PATENT DOCUMENTS

| | | |
|---|---|---|
| 0210462 | 2/1987 | European Pat. Off. . |
| 2370235 | 6/1978 | France . |

*Primary Examiner*—Carl D. Price

*Attorney, Agent, or Firm*—Burns, Doane, Swecker & Mathis

[57] ABSTRACT

In a combustion installation, a mixture of fresh air (D) and exhaust gas (C) is fed to the burner (A) via a mixing-/conveying device (EFG). There is provided in the combustion installation a heat exchanger (M), which undertakes the thermal conditioning of the mixture (H) before the latter is fed into the burner (A).

11 Claims, 3 Drawing Sheets

COMBUSTION INSTALLATION

BACKGROUND OF THE INVENTION

1. Field of the Invention

The invention relates to a combustion installation in accordance with the preamble of claim 1. It also relates to a method of operating such a combustion installation.

2. Discussion of Background

In combustion installations of standard design, the fuel is injected into a combustion chamber via a nozzle and burned there in conjunction with the feeding of combustion air. Basically, such combustion installations can be operated with a gaseous or liquid fuel. In the case of the use of a liquid fuel, the weak point as regards a clean burn in relation to the emissions of $NO_x$, CO and UHC is evidently the necessary comprehensive atomization (gasification) of the fuel, the degree of mixing of the latter with the combustion air, and combustion at temperatures as low as possible.

A typical feature of the use of a gaseous fuel is combustion with a substantial reduction as regards pollutant emissions because, by contrast with liquid fuel, gasification of the fuel is already provided. However, gas-operated burners have not prevailed, especially in the case of combustion installations for heating boilers, despite the many advantages which such burners can offer in this connection. The reason may be that the procurement or the distribution infrastructure of gaseous fuels is an expensive matter. If, as already set out above, a liquid fuel is used, the quality of the combustion as regards lower pollutant emissions is significantly dependent upon whether success is achieved in providing an optimum degree of mixing of the fuel/fresh air mixture, i.e. in guaranteeing a complete gasification of the liquid fuel. The approach of providing a premixing zone for the fuel/fresh air mixture upstream of the actual burner does not lead to the goal of an operationally reliable burner, because there is the imminent danger here that a flashback from the combustion zone into the premixing zone could damage the burner elements.

Premixing burners have become known which are operated with 100% excess of air, so that the flame is operated shortly before the point of extinction. However, because of the boiler efficiency, an excess of air of 15% at most is permissible with combustion installations. Consequently, to operate such burners in atmospheric combustion installations with the permitted excess of air does not result in optimum operation.

Even if the degree of gasification of the liquid fuel were to be largely achieved, there would still be no effect on the high flame temperatures, which are known to be responsible for the formation of $NO_x$. It is therefore not possible for the target combustion at low temperatures or the homogeneous mixing of the oil vapor with air to be guaranteed with the known premixing burners.

SUMMARY OF THE INVENTION

The invention is intended to provide a remedy in this regard. Accordingly, one object of this invention, as it is specified in the claims, is to minimize the pollutant emissions in the case of combustion installations of the type mentioned at the beginning, in connection with the operation both of liquid and of gaseous fuels, and in the case of a mixed operation.

The essential advantage of the invention is to be seen in that the excess of air for the premixing burner is replaced by exhaust gas. The addition of recirculated exhaust gases to the combustion air affects the flame temperature in the combustion chamber in such a way that the combustion proceeds at lower temperatures. In the case of operation with a liquid fuel, a thermally conditioned exhaust gas/fresh air mixture ensures that a completely evaporated fuel/combustion air mixture can be fed to the combustion. This improvement in exhaust gas evaporation, which is occasioned by the exhaust gas recirculation, and the lowering of the temperature in the combustion chamber has the effect, firstly, that the liquid fuel is burned like a gaseous fuel and, secondly, that the high flame temperatures responsible for the formation of $NO_x$ can no longer occur.

If, by contrast, the combustion installation is operated with a gaseous fuel, although a gasified mixture is already present the flame temperature experiences a positive influence here, too, due to the abovementioned exhaust gas recirculation. In the case of a mixed operation, all the advantages come to bear simultaneously.

Thus, the improvement as regards pollutant emissions of a combustion installation operated, generally speaking, with fossil fuels is not only of few percentage points, but the $NO_x$ emissions alone are minimized in such a way that in the optimum case perhaps only 10% of that is measured which is tolerated by the statutory limits. Consequently, an entirely new level of quality is achieved in this way.

As is required by statute, recirculation of cooled exhaust gases enables optimum operation of atmospheric combustion installations with a near-stoichiometric mode of operation.

A further advantage of the invention is based on a preferred embodiment of the burner. Despite this simplest geometrical embodiment, there must be no fear here either of a danger of flashback of the flame from the combustion chamber into the burner. The well known problems in the use of swirlers in a mixed flow, for example, those that can arise from the burning up of coatings with destruction of the swirl vanes, thus do not occur here. There is an improvement as regards pollutant emissions in conjunction with a permissible mode of operation.

Advantageous and expedient further developments of the achievement of the objects according to the invention are specified in the further dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, in which all elements not required for the immediate understanding of the invention are omitted, and wherein.

DESCRIPTION OF THE PREFERRED EMBODIMENTS

Figure 1:
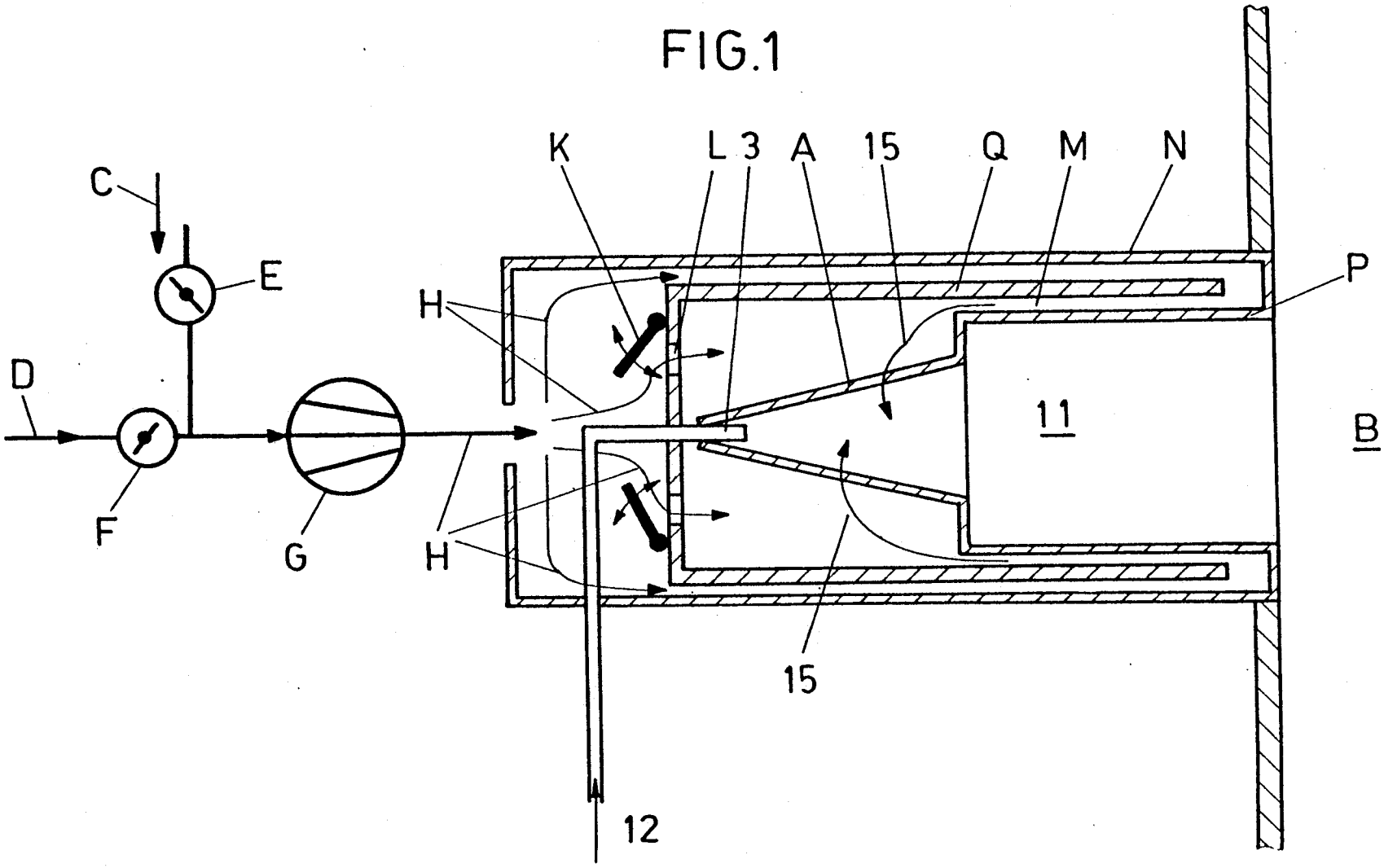
FIG. 1 shows a combustion installation with a burner, a circuit for exhaust gas circulation and mixing with air, and thermal treatment of the combustion air, all in a diagrammatic representation.

Referring now to the drawings, wherein like reference numerals designate identical or corresponding parts throughout the several views and wherein the directions of flow of the different media are specified by arrows, FIG. 1 shows a combustion installation in a diagrammatic representation. The combustion installation N consists of a burner A, which will be considered in further detail later, to which there is joined in the direction of flow a flame pipe P, which extends, for its part, over the entire combustion chamber 11. The boiler B of the combustion installation is located on the outflow side of the flame pipe P. A concentric pipe Q that is a component of a heat exchanger M is located between the outer casing of the combustion installation N and the flame pipe P. The concentric pipe Q has a sealing cover in the approach-flow direction that has one or a plurality of bypass devices. These each consist of an opening L with an associated bypass flap K. A pipeline coming in from outside feeds the liquid fuel 12 to a nozzle 3 in the burner A. Upstream of the burner A is a control for preparing an air/exhaust gas mixture H: the exhaust gases C led up from the flue and the fresh air D from the environment each flow through a proportioning device E and F, respectively, and are formed here at the desired ratio into a mixture H at a temperature of approximately 50°-100° C., before said mixture is conveyed into the combustion installation N via a blower G. The blower G firstly conveys the mixture to a heat exchanger M, which is integrated to the flame pipe P and is constructed, for example, as a pipe that is ribbed on both sides or on side and in which the heating of the mixture H takes place to the desired temperature. This temperature can be brought to the desired value with the aid of the bypass flaps K already mentioned by appropriate connection. The fresh air/exhaust gas mixture 15, which is now conditioned and preferably has a temperature of approximately 400° C., flows through the burner A (see FIG. 2 in this connection), and is mixed with the liquid fuel 12 from the nozzle 3, which now easily and rapidly evaporates because of the temperature of the mixture 15. Combustion then begins at the outlet of the burner A (cf. description from FIG. 2). Part of the heat released is now transferred via the heat exchanger M to the mixture H, before the exhaust gas passes into the boiler B and then into the flue. With this concept, the blower G, heat exchanger M and burner A can be installed together in a single housing, which is flanged, in a manner analogous to conventional burners, to the boiler B. Furthermore, the type of operation described above and the type of burner described below enable a large amount of exhaust gas C to be recirculated, which not only has a positive effect on the temperature of the air/exhaust gas mixture, but also has the effect that the flame temperature can be lowered as far as possible, and this counteracts the formation of $NO_x$. Consequently, no problems arise with the surface temperature of the burner. The circuit described here has a number of other advantages such as, for example, that the degree of recirculation of the exhaust gas C, and the preheating temperature of the conditioned mixture 15 can be adjusted simply and in a definite fashion. Due to the fact that the blower G does not come into contact with heating gases, the smallest possible blower power is required and, moreover, normal design solutions with standard materials can be used for this purpose. Furthermore, the present circuit proves to be advantageous to the extent that good dynamics are to be observed at burner start-up, and these make possible a rapid achievement of the desired air temperature.

Figure 2:
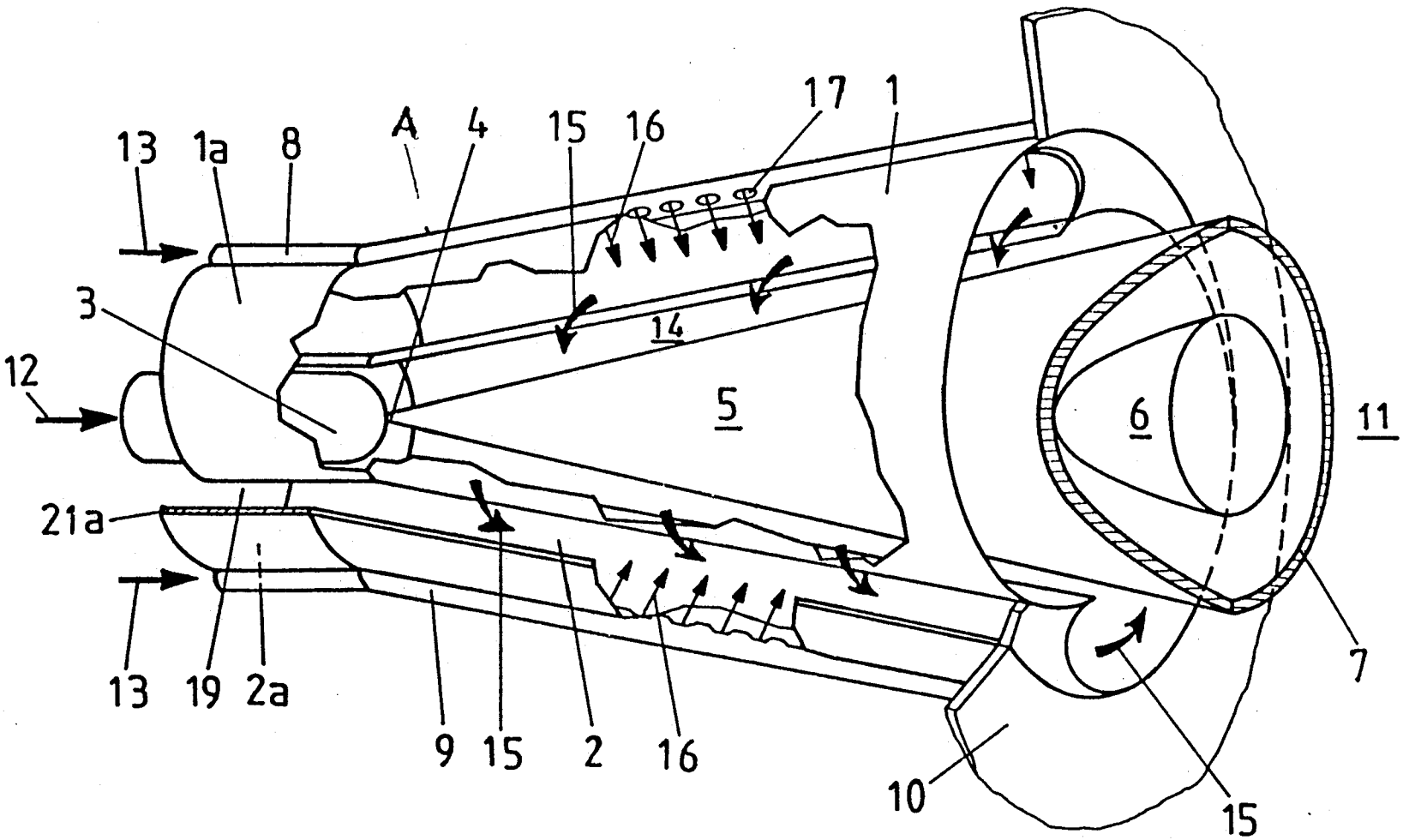
FIG. 2 shows a burner for liquid and/or gaseous fuels for operating a combustion installation according to FIG. 1, in a perspective representation correspondingly cut away.
Figure 3:
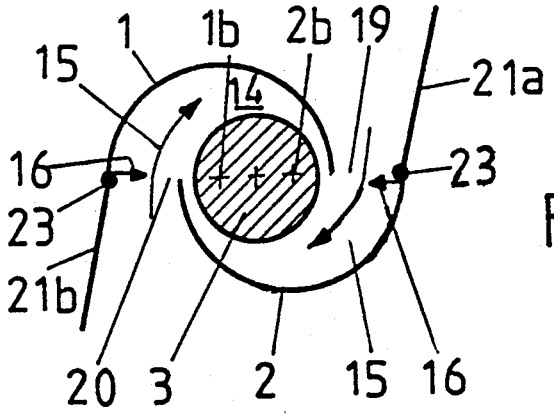
FIGS. 3, 4 and 5 show corresponding sections through the planes III—III (FIG. 3), IV—IV (FIG. 4), and V—V (FIG. 5), these sections being only a diagrammatic. simplified representation of the burner according to FIG. 2.
Figure 4:
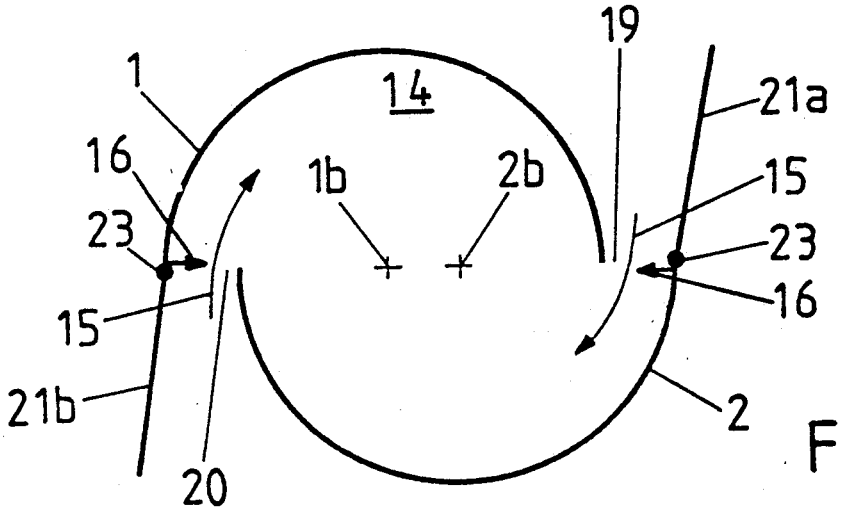
Figure 5:
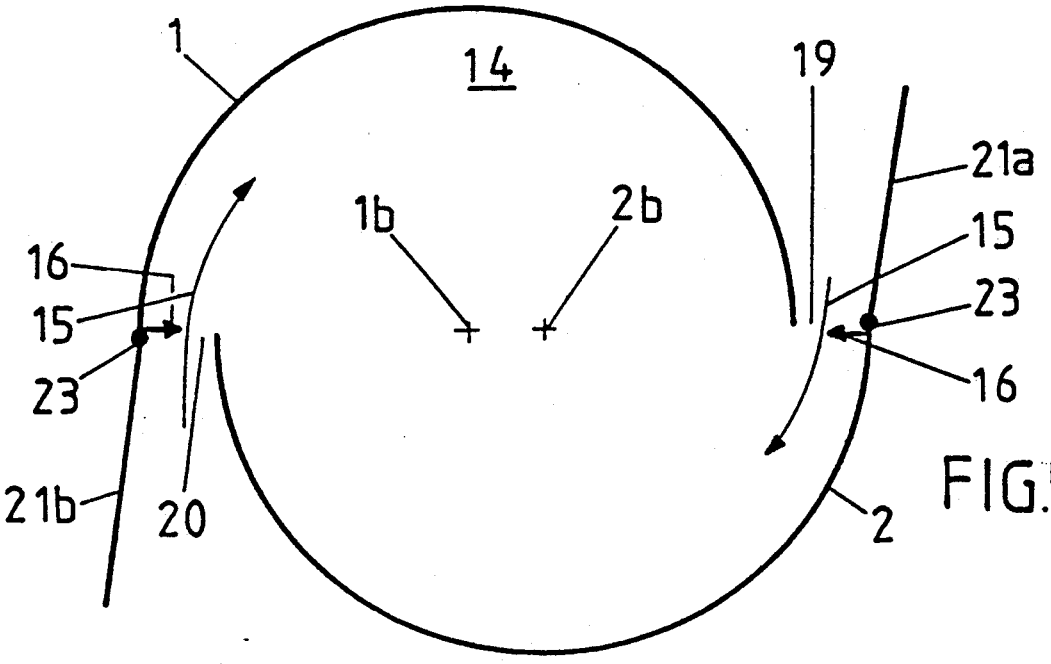

It is advantageous for a better understanding of the construction of the burner A if the reader refers simultaneously to FIG. 2 and the individual sections according to FIGS. 3-5. Furthermore, in order not to clutter up FIG. 2 unnecessarily, it carries only an indication of the baffle plates 21*a*, 21*b* shown diagrammatically according to FIGS. 3-5. The description of FIG. 2 below also makes reference as necessary to the remaining FIGS. 3-5.

The burner A in accordance with FIG. 2, which is a premixing burner, which can be used in the case of atmospheric combustion installations, consists of two hollow half partial conical bodies 1, 2, which are arranged mutually offset on one another. The mutual offset of the respective central axis l*b*, 2*b* of the partial conical bodies 1, 2 uncovers on both sides in a mirror arrangement one tangential air inlet slot 19, 20 (FIGS. 3-5), through which the conditioned mixture 15 (preheated exhaust gas/fresh air mixture) flows into the interior of the burner A, i.e. into the conical cavity 14. The two partial conical bodies 1, 2 each have a cylindrical initial part l*a*, 2*a*, which likewise extend, in a manner analogous to the partial conical bodies 1, 2, in a mutually offset fashion, so that the tangential air inlet slots 19, 20 are present from the beginning. Accommodated in this cylindrical initial part l*a*, 2*a* is a nozzle 3, of which the fuel injection 4 coincides with the narrowest cross-section of the conical cavity 14 formed by the two partial conical bodies 1, 2. It is, of course, possible for the burner A to be embodied purely conically, that is to say without cylindrical initial parts l*a*, 2*a*. Both partial conical bodies 1, 2 each have a fuel pipeline 8, 9, which are provided with fuel nozzles 17, through which flows the gaseous fuel 13, which can be mixed with the conditioned mixture 15 flowing through the tangential air inlet slots 19, 20. The position of these fuel pipelines 8, 9 follows diagrammatically from FIGS. 3-5: the fuel pipelines 8, 9 are fitted at the end of the tangential air inlet slots 19, 20, so that there, too, mixing 16 of the gaseous fuel 14 with the inflowing conditioned mixture 15 takes place. A mixed operation with both types of fuel is, of course, possible. On the combustion chamber side 22, the burner A has an end wall 10, which forms the start of the combustion chamber 11. The liquid fuel 12 flowing through the nozzle 3 is injected at an acute angle into the conical cavity 14 in such a way that as homogeneous and conical a fuel spray as possible arises in the burner exit plane. The fuel injection 4 can be an air-supported nozzle or a mechanical atomizer. The conical liquid fuel profile 5 is surrounded by a tangentially inflowing, rotating mixed flow 15. The concentration of the liquid fuel 12 is continuously reduced in the axial direction by the combustion air 15 that is mixed in. If gaseous fuel 13 is injected 16, the formation of the mixture with the conditioned "combustion air" 15 takes place directly at the end of the air inlet slots 19, 20. When the liquid fuel 12 is injected, the optimum, homogeneous fuel concentration over the cross-section is achieved in the region where the vortex breaks down, that is to say in the region of the return flow zone 6, in that the vortex flow imposes an angular velocity component on the fuel droplets produced by the oil nozzle.

The centrifugal force thereby produced drives the droplets of the liquid fuel 12 radially outwards. However, evaporation acts at the same time. In the case under discussion, the result of the interplay of centrifugal force and evaporation is that the inner walls of the partial conical bodies 1, 2 are not wetted, and that a very uniform fuel/air mixture comes about in the region of the return flow zone 6. The ignition takes place at the peak of the return flow zone 6. It is not until this point that a stable flame front 7 can arise. Here, there would be no fatal consequences of a kickback of the flame into the interior of the burner, as is always to be feared in the case of known premixing sections, where remedy is sought, however, against this with complicated flame retention baffles. If the conditioned mixture 15 is preheated, as is the case in the present example, an accelerated, comprehensive evaporation of the liquid fuel 12 arises, as is explained in the description of FIG. 1, before the point is reached at the outlet of the burner A, at which the ignition of the mixture can take place. The degree of evaporation is, of course, dependent upon the size of the burner A, the drop size distribution, and the temperature of the conditioned mixture 15. However, independently of whether, apart from the homogeneous drop premixing, low temperature is achieved due to a mixture 15, or in addition only a partial or the complete drop evaporation is achieved due to a preheated, conditioned mixture 15, the nitrogen oxide and carbon monoxide emissions turn out to be low if the excess of air is at least 60%, or the excess of air is replaced by exhaust gas, thereby providing here an additional arrangement for minimizing the $NO_x$ emissions. In the case of complete evaporation of the liquid fuel 12 before entry into the combustion zone (combustion chamber 11), the pollutant emission values are at their lowest. The same also holds for near-stoichiometric operation, when the excess of air is replaced by recirculating exhaust gas C. Narrow limits are to be observed in the configuration of the partial bodies 1 or 2 with respect to the cone inclination and the width of the tangential air inlet slots 19, 20, in order that for the purpose of flame stabilization the desired flow field of the air with its return flow zone 6 arises in the region of the burner aperture. It may be said in general that a reduction in size of the tangential air inlet slots 19, 20 displaces the return flow zone 6 further upstream, which would then mean, however, the mixture igniting earlier. Nevertheless, it can be said here that, once fixed geometrically, the return flow zone 6 is positionally stable per se, because the swirl coefficient increases in the direction of flow in the region of the conical form of the burner A. The design of this burner A is eminently suitable, in the case of a predetermined overall burner length, for changing the size of the tangential air inlet slots 19, 20, in that the partial conical bodies 1, 2 are fixed, for example, to the wall 10 with the aid of a detachable connection (not visible in the FIG.). Displacing the two partial conical bodies 1, 2 radially towards or away from one another reduces or increases the spacing of the two central axes 1*a*, 1*b* (FIGS. 3–5), and there is a corresponding change in the gap width of the tangential air inlets 19, 20, as may be understood particularly well from FIGS. 3–5. The partial conical bodies 1, 2 can also, of course, be displaced towards one another in another plane, whereby it is even possible to approach an overlapping of the same. Indeed, it is even possible to displace the partial conical bodies 1, 2 helically in one another through a counter-rotating movement. The possibility is thus to hand of arbitrary variation of the form and size of the tangential air inlets 19, 20, so that the burner A can be individually matched without changing its overall length.

The position of the baffle plates 21*a*, 21*b* also follows from FIGS. 3–5. They have flow introduction functions, extending, as they do, the particular end of the partial conical bodies 1 and 2 in the approach-flow direction of the combustion air 15, depending upon their length. The channeling of the combustion air into the conical cavity 14 can be optimized by opening or closing the baffle plates 21*a*, 21*b* about the fulcrum 23, this being especially necessary if the original gap width of the tangential air inlet slots 19, 20 is changed. The burner A can also, of course, be operated without baffle plates 21*a*, 21*b*.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of operating a combustion installation comprising the following steps:

supplying a combustible fuel to a burner;

operating said burner such that exhaust gases are released from said burner to an exhaust area, said burner being mounted on a frame and having a combustion chamber disposed downstream of said burner of said frame;

directing exhaust gas to a means for mixing said exhaust gas with fresh air to form combustion air;

directing said combustion air to a heat exchanger that is disposed downstream of said burner on said frame, said heat exchanger drawing heat from said combustion chamber;

heating said combustion air in said heat exchanger; and, directing said heated combustion air to said burner.

2. A combustion installation comprising:

a frame having a combustion chamber;

a burner mounted on said frame upstream of said combustion chamber;

means for supplying fuel to said burner;

means for mixing exhaust gas with fresh air to form combustion air;

means for supplying said combustion air from said means for mixing to said burner;

heat exchanger means for preheating said combustion air prior to supplying said combustion air to said burner, said heat exchanger means being disposed downstream of said burner on said frame; and, said burner including at least two hollow part-conical bodies mated together in an offset relationship and having tangential air inlet slots for receiving said combustion air and having a conical inclination increasing in a flow direction, said air inlet slot extending substantially the length of said burner, said burner including a nozzle means for supplying a conical column of liquid fuel substantially along the length of said burner, said nozzle means being disposed between said conical bodies at a burner head of said burner.

3. A combustion installation comprising:

a frame having a combustion chamber;

a burner mounted on said frame upstream of said combustion chamber;

means for supplying fuel to said burner;

means for mixing exhaust gas with fresh air to form combustion air;

means for supplying said combustion air from said means for mixing to said burner;

heat exchanger means for preheating said combustion air prior to supplying said combustion air to said burner, said heat exchanger means being disposed downstream of said burner on said frame.

4. A combustion installation according to claim 3, wherein said burner includes at least two hollow part-conical bodies mated together in an offset relationship and having tangential air inlet slots for receiving said combustion air and having a conical inclination increasing in a flow direction, said air inlet slots extending substantially the length of said burner, said burner including a nozzle means for supplying a conical column of liquid fuel substantially along the length of said burner, said nozzle means being disposed between said conical bodies at a burner head of said burner.

5. A combustion installation according to claim 4, wherein nozzle means is a liquid fuel nozzle.

6. A combustion installation according to claim 4, wherein said burner further includes a plurality of fuel nozzle means disposed along said air inlet slots.

7. A combustion installation according to claim 6, wherein said plurality of fuel nozzle means are gaseous fuel nozzles.

8. A combustion installation according to claim 4, wherein said burner includes means for displacing said part-conical bodies relative to each other.

9. A combustion installation according to claim 4, wherein said nozzle means is an air supported nozzle.

10. A combustion installation according to claim 4, wherein said nozzle means is a mechanical atomizer.

11. A combustion installation according to claim 4, wherein said burner further includes movable baffle plates are connected to said part-conical bodies for channeling said combustion air.

* * * * *